US008020982B2

(12) United States Patent
Mun et al.

(10) Patent No.: US 8,020,982 B2
(45) Date of Patent: Sep. 20, 2011

(54) BUBBLE REMOVING APPARATUS FOR INKJET PRINTER AND METHOD OF REMOVING AIR BUBBLES USING THE SAME

(75) Inventors: Il-ju Mun, Suwon-si (KR); Young-su Lee, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 885 days.

(21) Appl. No.: 11/865,828

(22) Filed: Oct. 2, 2007

(65) Prior Publication Data

US 2008/0273070 A1 Nov. 6, 2008

(30) Foreign Application Priority Data

May 4, 2007 (KR) ..... 10-2007-0043732

(51) Int. Cl.
*B41J 2/19* (2006.01)
*B41J 2/175* (2006.01)

(52) U.S. Cl. ..... 347/92; 347/93

(58) Field of Classification Search ..... 347/89, 347/92, 93

See application file for complete search history.

(56) References Cited

U.S. PATENT DOCUMENTS 3,786,517 A * 1/1974 Krause ..... 347/74
4,435,719 A * 3/1984 Snaper ..... 347/82
5,231,424 A * 7/1993 Kaneko et al. ..... 347/29
5,699,095 A * 12/1997 Mitsuzawa et al. ..... 347/92
5,956,062 A * 9/1999 Omata et al. ..... 347/89
6,231,174 B1 * 5/2001 Haigo ..... 347/89
6,428,156 B1 * 8/2002 Waller et al. ..... 347/89
7,661,803 B2 * 2/2010 Morgan et al. ..... 347/85

OTHER PUBLICATIONS

CN Office Action issued May 25, 2011 in CN Patent Application No. 200810004884.2.

* cited by examiner

*Primary Examiner* — Anh T. N. Vo
(74) *Attorney, Agent, or Firm* — Stanzione & Kim, LLP

(57) ABSTRACT

A bubble removing apparatus for removing air bubbles in ink to be supplied to a printer head of an inkjet printer and a method of removing the air bubbles are provided to provide a smooth flow of ink to the inkjet printer head. When an air bubble removing operation is performed, ink in an ink tank is moved towards the printer head through a filter unit by operating the pump in a forward direction, and the ink that has moved towards the printer head is returned to the ink tank through the filter unit by operating the pump in a reverse direction. Air bubbles trapped in the filter unit are moved to the ink tank due to the operation of the pump in the reverse direction and are removed in the ink tank by the gravitational force, and thereby a smooth flowing ink supply can be provided to the printer head.

10 Claims, 8 Drawing Sheets

BUBBLE REMOVING APPARATUS FOR INKJET PRINTER AND METHOD OF REMOVING AIR BUBBLES USING THE SAME

CROSS-REFERENCE TO RELATED APPLICATIONS

This application claims the benefit of Korean Patent Application No. 10-2007-0043732, filed on May 4, 2007, in the Korean Intellectual Property Office, the disclosure of which is incorporated herein in its entirety by reference.

BACKGROUND OF THE INVENTION

1. Field of the Invention

The present general inventive concept relates to an apparatus to remove air bubbles in ink to be supplied to an inkjet printer head of an inkjet printer and a method of removing the air bubbles, and more particularly, to a bubble removing apparatus that can be applied to an array head of an inkjet printer that uses a line printing method, and method of removing the air bubbles using the same.

2. Description of the Related Art

Conventionally, an inkjet printer prints a desired image on paper by ejecting ink droplets onto the paper. As illustrated in FIG. 1, an inkjet printer is formed as part of a conventional image printing apparatus and includes a printer head 10 that ejects ink droplets through nozzles 11*a*, a pair of feed rollers 21 that push a paper P, received from a front-end portion 15 of a conventional image printing apparatus, under the printer head 10, and a pair of discharge rollers 22 that discharge the paper P to a tray 30. The front-end portion 15 may include a scanning unit to scan an image and a paper storage unit to store blank sheets of paper (not illustrated). When the feed rollers 21 push the paper P under the printer head 10, the printer head 10 prints a desired image by ejecting ink droplets through the nozzles 11*a* of a chip 11, and the discharge rollers 22 push out the paper P on which the desired image is printed to the tray 30.

Printing methods include a shuttle method in which an image is printed on a paper P in a horizontal writing method while the printer head 10 reciprocally moves back and forth over the width of the paper P, and a line printing method in which a fixed printer head 10 is formed to cover the whole width of the paper P and an entire line of the image is simultaneously printed. Recently, the line printing method, that is, an array head is widely used due to its high printing speed.

In the inkjet printer described above, since an image is printed by ejecting ink droplets through the nozzles 11*a* formed in the chip 11 of the printer head 10, if the nozzles 11*a* are blocked by air bubbles, ink cannot be properly ejected, thus the image cannot be accurately printed. In order to avoid this problem, various methods to remove air bubbles in the ink have been proposed. A method commonly used is sucking out the air bubbles present inside the nozzles 11*a* together with a small amount of ink using a pump after covering a suction cap on the chips 11 of the printer head 10. This method is effective in a shuttle method head having small number of chips 11 and a relatively small area. However, in the case of an array head operating in a line printing method in which the chips 11 are widely disposed almost to cover the entire width of the paper P, it is difficult to apply the suction method. That is, in order to cover the entire width of the paper P, a lot of chips 11 having nozzles 11*a* must be disposed in the widthwise direction of the paper P. In this case, it is difficult to seal each of the entire chips 11 with a cap and to suck out air bubbles by applying a uniform pressure to all of the nozzles 11*a*. In the case of the array head, in order to address this problem, as illustrated in FIG. 2, an ink circulation line 60 is formed between the printer head 10 and an ink tank 50 and ink in the printer head 10 is circulated by operating a pump 70 when necessary. That is, air bubbles are induced into the ink tank 50 by periodically circulating the ink in the nozzles 11*a* and the air bubbles are separated by gravitational difference. Reference numeral 40 indicates a negative pressure generator that maintains the pressure in the nozzles 11*a* of the chip 11 at a negative pressure, and reference numeral 90 indicates a filter unit for filtering foreign materials included in the ink. Thus, the ink in the ink tank 50 is supplied to the printer head 10 to be used for printing work by the pump 70, and in this process, any foreign materials included in the ink are filtered by the filter unit 90. When it is necessary to remove air bubbles, a valve 80 is opened to circulate the ink. Thus, air bubbles are collected in the ink tank 50, and are separated by the gravitational force.

As illustrated in FIG. 3, a filter unit 90 having a vertical structure is widely used, in which a filter 92 is vertically mounted in a housing 91 having an ink inlet 91*a* and an ink outlet 91*b*. That is, ink that enters the filter unit 90 through the ink inlet 91*a* is filtered while passing through the filter 92, and then, is supplied to the printer head 10 through the ink outlet 91*b*.

As illustrated in FIG. 3, air bubbles B that enter the housing 91 of the filter unit 90 are held in the housing without passing through the filter 92. That is, the air bubbles B typically enter when the ink circulation line 60 is refilled after the ink tank 50 is replaced. The air bubbles B that have entered the filter unit 90 in this way cannot pass through a mesh of the filter 92 and are held on the side of the ink inlet 91*a* of the housing 91. In this case, due to the air bubbles B, an area of the filter 92 to be used is reduced, thereby increasing pressure loss. That is, this situation is equivalent to the case where the cross-sectional area of a pipeline is reduced, and thus, a pressure drop occurs at the filter unit 90. Accordingly, a stable ink supply to the printer head 10 cannot be achieved resulting in the poor printing quality. In order to determine the trend of pressure loss when a working area of the filter 92 is gradually reduced, an experiment was performed. FIG. 5 is a graph showing the measurement result of pressure drop at the boundary of an ink inlet and ink outlet of a housing when filters having different diameters from each other are used. Filters respectively having a diameter of 10 mm, 20 mm, 30 mm, and 40 mm were used in order to correspond to the situation where a filter having a diameter of 40 mm is used at first and the diameter of the filter is then gradually reduced to 30 mm, 20 mm, and 10 mm due to the air bubbles. The size of mesh is unchanged. From the graph, it is seen that as the working area of the filter is gradually reduced, the pressure drop rapidly increases.

In order to address this problem, a method of increasing the speed of fluid can be employed. That is, a large amount of ink is rapidly passed through the filter 92 so as to allow the air bubbles to penetrate through the mesh without being held in the filter unit 90. However, when the flow speed of the ink is increased, a negative pressure at the nozzles 11*a* of the printer head 10 is increased. Thus, external air can enter the printer head 10 through the nozzles 11*a*, and the external air can be a source of air bubble generation. Therefore, increasing the flow speed of ink is not a desirable solution.

As illustrated in FIG. 4, there is a structure in which a filter 12 is horizontally installed on a front end of a chip 11 in the printer head 10. In this structure, air bubbles B generated during ejection of ink through the nozzles 11*a* float and gather at an ink outlet side of the filter. Also, as it is well known in the art, a heater (not shown) is installed in the printer head 10 corresponding to each of the nozzles 11*a*. Ink droplets are ejected through the corresponding nozzle 11*a* by small air bubbles generated due to heat of the heater. The small air bubbles generated at this point rise to the filter 12 and cannot pass through the filter 12. In this case also, the air bubbles interrupt the ink from flowing towards the nozzle 11*a*. For example, when the heater is operated in a state where the ink is not filled inside the filter 12, the lifetime of the printer head 10 can be greatly reduced due to overheating.

Therefore, to address the above problems, there is a need to develop a method of smoothly removing air bubbles embedded in ink.

SUMMARY OF THE INVENTION

To solve the above and/or other problems, the present general inventive concept provides a bubble removing apparatus for an inkjet printer that can smoothly remove air bubbles that are included in ink and held around a filter, and a method of removing the air bubbles using the bubble removing apparatus.

Additional aspects and utilities of the present general inventive concept will be set forth in part in the description which follows and, in part, will be obvious from the description, or may be learned by practice of the general inventive concept.

According to an aspect of the present general inventive concept, there is provided a bubble removing apparatus including an ink circulation line that connects an ink tank containing ink and a printer head, a filter unit installed on the ink circulation line to filter out foreign materials contained in the ink, and a pump capable of operating in a forward and a reverse direction to circulate the ink in the forward direction and in the reverse direction through the ink circulation line.

The ink circulation line may have a length L1 from the filter unit to the printer head greater than a length L2 from the filter unit to the ink tank where L1>L2.

The filter unit may include a housing having an ink inlet and an ink outlet and having a filter disposed between the ink inlet and the ink outlet, wherein the housing may be tapered such that the cross-sectional area of the housing gradually decreases in a direction away from the ink inlet.

The ink inlet and the ink outlet may be formed at an upper end of the housing.

According to another aspect of the present general inventive concept, there is provided an image forming apparatus including a printer head, an ink tank to contain ink, and an air bubble removing apparatus having an ink circulation line to connect the ink tank and the printer head, a filter unit installed on the ink circulation line to filter out foreign materials contained in the ink, and a pump capable of operating in a forward and a reverse direction that operates to circulate the ink in the forward direction and in the reverse direction through the ink circulation line.

According to another aspect of the present general inventive concept, there is provided a method of removing air bubbles of an inkjet printer including moving ink from an ink tank to a printer head through a filter unit on an ink circulation line by operating a pump that can be operated in a forward and a reverse direction in the forward direction; and moving ink that has been moved to the printer head back to the ink tank through the filter unit by operating the pump in the reverse direction.

The operation of the pump in the forward direction may be continued until the distance the ink has been moved in the ink circulation line after leaving the filter unit is greater than the length of the ink circulation line between the ink tank and the filter unit, and the operation of the pump in a reverse direction may be continued until the ink has been moved a distance which is substantially the same as the length of the ink circulation line from the filter unit to the ink tank and before all of the ink that passed through the filter unit when the pump was operated in the forward direction has returned to the filter unit.

The method may further include moving the ink in the ink tank to the printer head by operating the pump in the forward direction after operating the pump in the reverse direction.

According to another aspect of the present general inventive concept, there is provided a method of removing air bubbles in an inkjet printer including moving ink in a first direction in an ink circulation line from an ink tank through a filter unit and toward a printer head, and moving the ink in the ink circulation line in a second direction opposite from the first direction, wherein the ink is lived in the first direction a distance L1 the ink is moved in the second direction a distance L2 and L1 is greater than L2.

L1 may be substantially the length of the ink circulation line from the filter unit to the printer head.

L2 may be substantially the length of the ink circulation line from the filter unit to the ink tank.

Moving the ink in the first direction may cause air bubbles embedded in the ink to become trapped in the filter unit.

Moving the ink in the second direction may cause substantially all the trapped air bubbles to be moved into the ink tank.

According to another aspect of the present general inventive concept, there is provided an image forming apparatus including a printer head, an ink tank to contain ink, and an air bubble removing apparatus having an ink circulation line to connect the ink tank and the printer head, a filter unit installed on the ink circulation line and spaced apart from the printer head a first distance and spaced apart from the ink tank a second distance shorter than the first distance.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
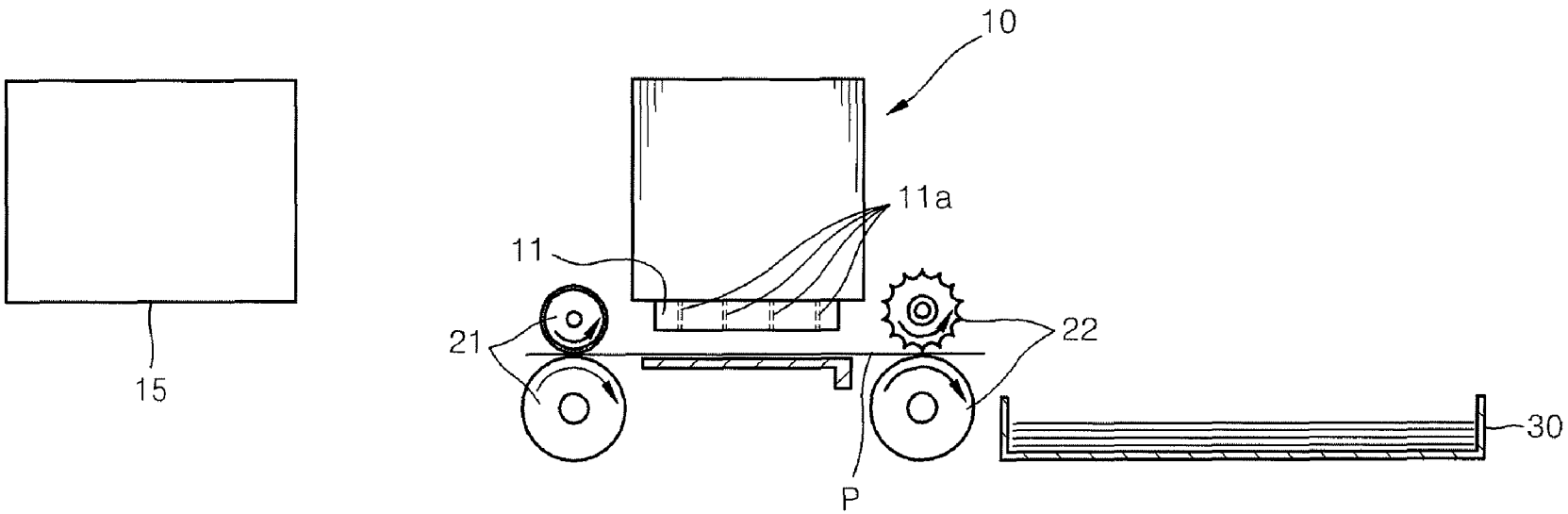
FIG. 1 (PRIOR ART)
FIG. 1 is a schematic view illustrating a printing structure of a conventional inkjet printer.
Figure 2:
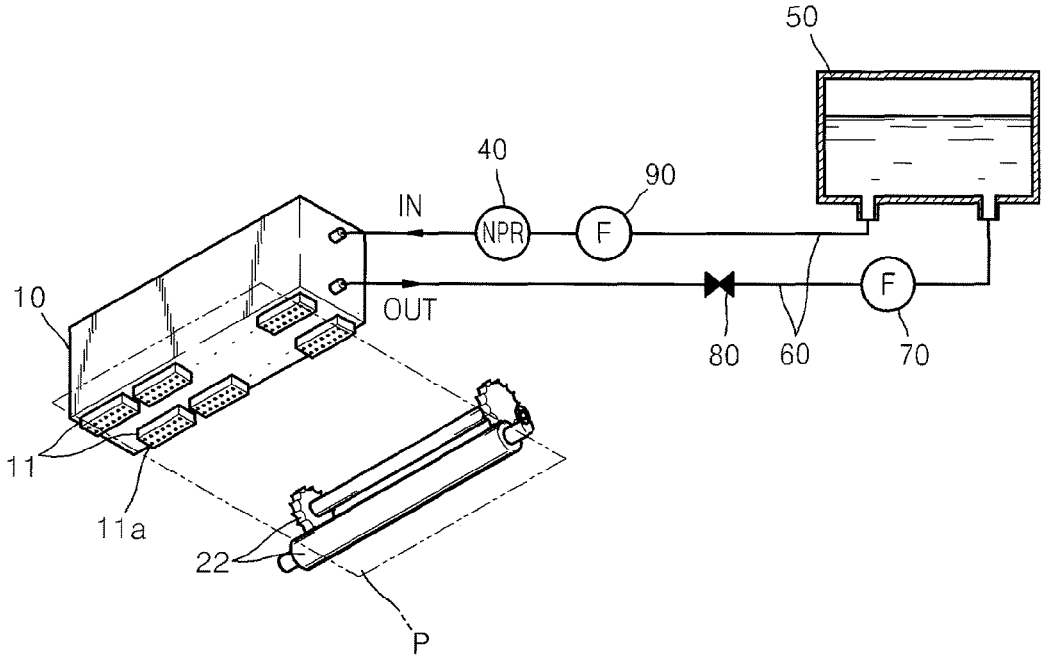
FIG. 2 (PRIOR ART)
FIG. 2 is a schematic view illustrating a configuration of a conventional bubble removing apparatus.
Figure 3:
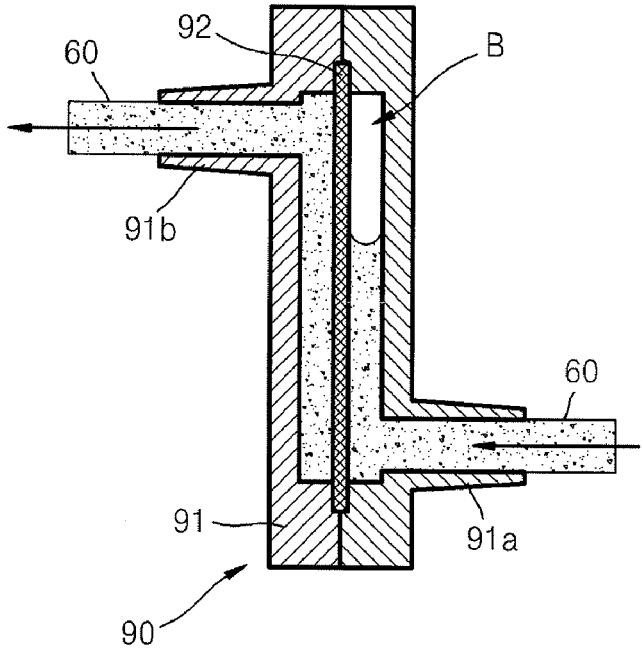
FIG. 3 (PRIOR ART)
FIGS. 3 and 4 are conventional filter units of the bubble removing apparatus of FIG. 2.
Figure 4:
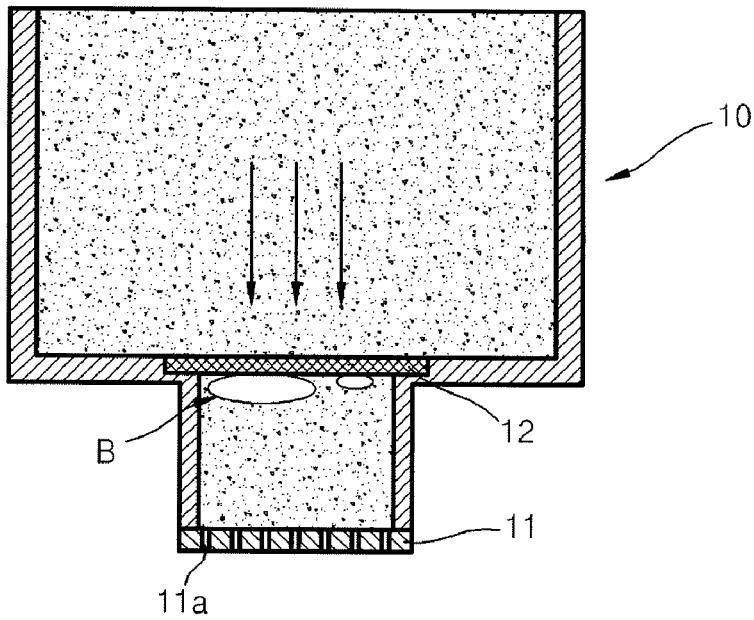
FIG. 4 (PRIOR ART)
Figure 5:
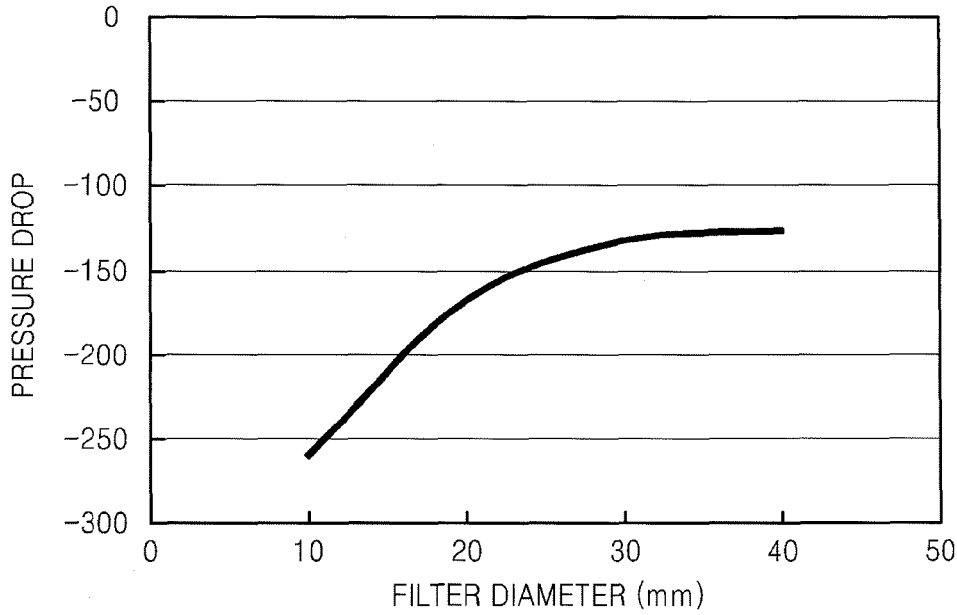
FIG. 5 (PRIOR ART)
FIG. 5 is a graph illustrating a pressure drop according to the reduction of active filter area in the filter unit of FIG. 3.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 6:
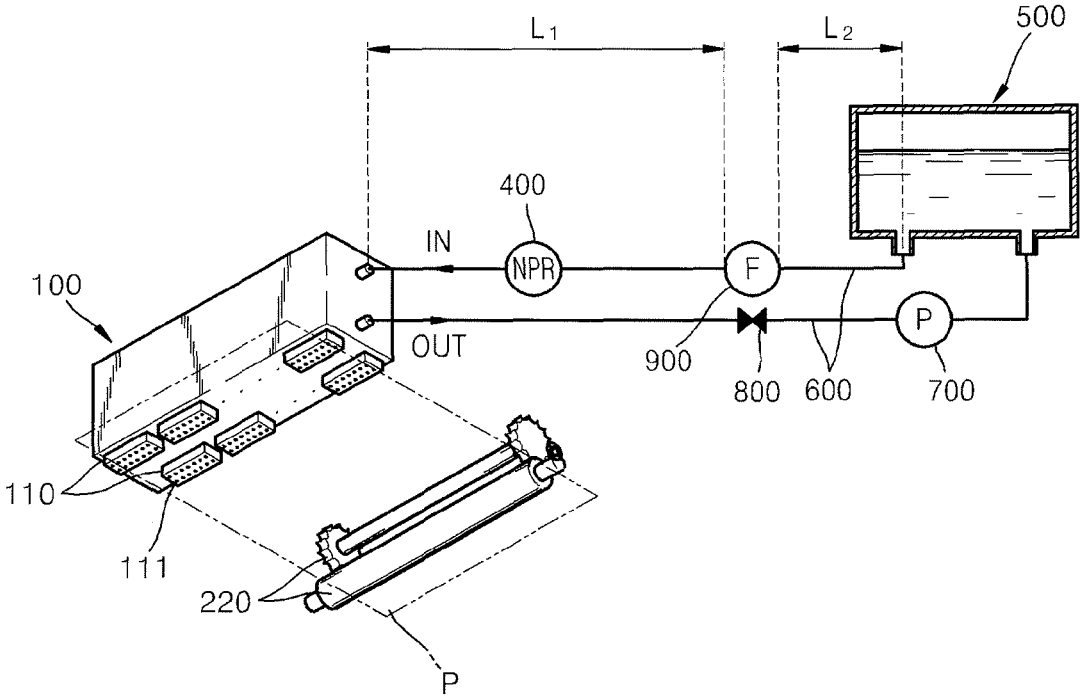
FIG. 6 is a schematic view illustrating a configuration of a bubble removing apparatus according to an embodiment of the present general inventive concept.

FIG. 6 is a schematic view illustrating a configuration of a bubble removing apparatus according to an embodiment of the present general inventive concept. The present general inventive concept may be part of or used in conjunction with a conventional image forming apparatus.

Referring to FIG. 6, a bubble removing apparatus according to an embodiment of the present general inventive concept has a structure in which a printer head 100 and an ink tank 500 are connected via an ink circulation line 600 to circulate ink by operating a pump 700 when necessary. When the pump 700 is operated with the opening of a valve 800, ink circulates in the printer head 100 and the ink tank 500 through the ink circulation line 600. Reference numeral 110 indicates chips where nozzles 111 are formed, reference numeral 400 indicates a negative pressure generator, and reference numeral 900 indicates a filter unit. Discharge rollers 220 are provided to engage paper P after printing to discharge paper P into tray 30.

The pump 700 is a reversible pump, that is, can be driven in a forward direction and a reverse direction. That is, the pump 700 is configured that when the pump 700 is driven in the forward direction, ink in the ink tank 500 flows towards the printer head 100 through the filter unit 900 to remove foreign objects from the ink, and when the pump 700 is driven in the reverse direction, the ink that flows towards the printer head 100 returns to the ink tank 500 through the filter unit 900. This is a method of removing air bubbles held in the filter unit 900. A detailed method of removing air bubbles will be described below. Also, assuming that a first distance from the filter unit 900 to the printer head 100 is L1 and a second distance from the filter unit 900 to the ink tank 500 is L2, the filter unit 900 may be installed to satisfy a condition where L1>L2, which will be described in more detail below.

The first distance L1 may be an actual length of the ink circulation line 600 measured from the first port formed on the printer head 100 to the first port formed on the filter unit 900, and the second distance L2 may be an actual length of the ink circulation line 600 measured from the second port formed on the filter unit 900 to the first port formed on the ink tank 500. The actual length of the ink circulation line 600 is measured for L1 and L2 regardless of whether the ink circulation line 600 is straight, curved, or otherwise disposed between the printer head 100, the filter unit 900, and the ink tank 500.

Figure 7:
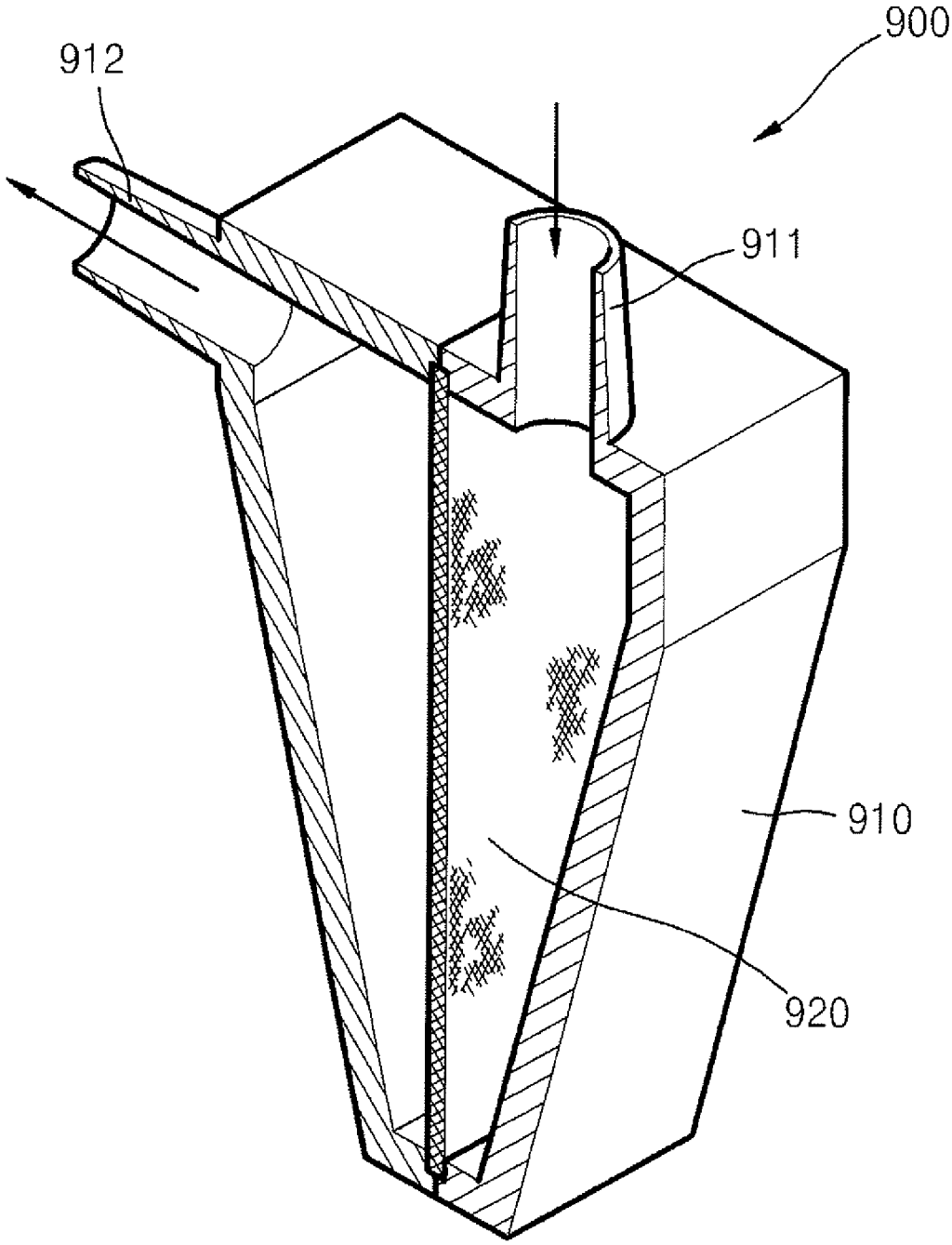
FIG. 7 is a perspective view illustrating a structure of a filter unit of the bubble removing apparatus of FIG. 6, according to an embodiment of the present general inventive concept.
Figure 8A:
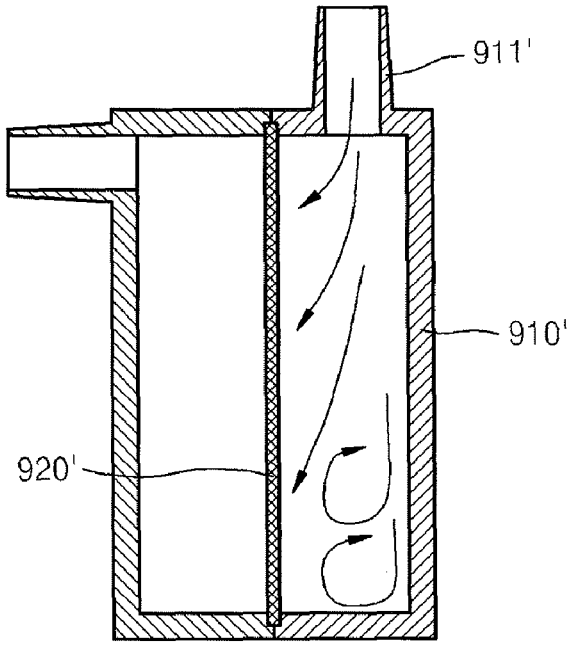
FIGS. 8A and 8B are cross-sectional views illustrating the shape of the filter unit of FIG. 7, according to an embodiment of the present general inventive concept.
Figure 8B:
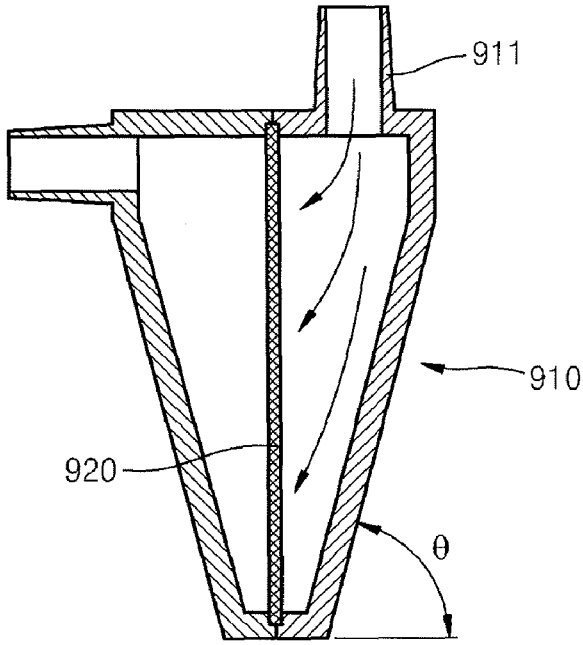

As illustrated in FIG. 7, the filter unit 900 includes a housing 910 having an ink inlet 911 and an ink outlet 912, and a filter 920 vertically installed in the housing 910. The ink inlet 911 and the ink outlet 912 are formed at upper end of the housing 910, thus, ink that enters the housing 910 through the ink inlet 911 passes through the filter 920 by wetting the entire surface, from the upper end to the lower end, of the filter 920 and leaves through the ink outlet 912. In this embodiment, the housing 910 tapers inward towards the lower end t thereof so that a cross-sectional area of the housing 910 gradually reduces towards the bottom end of the housing 910 away from the ink inlet 911. In this way, a turbulent flow that interrupts the flow of ink in the bottom end of housing 910 away from the ink inlet 911 can be prevented. That is, as illustrated in FIG. 8A, if a housing 910' is not tapered and has a shape having a constant cross-sectional area, ink that enters the housing 910 cannot pass through a filter 920' because of a turbulent flow in a lower end of the housing 910'. When a turbulent flow is formed, the turbulent flow interrupts the ink from flowing downwards, and thus, the flow of ink is not smooth or substantially laminar. Therefore, as illustrated in FIG. 8B, if the housing 910 is formed in a tapered shape, excess space which causes the turbulent flow at the lower end of housing 910' is eliminated. In this case, since the turbulent flow region is removed, the ink flow is substantially laminar. In an exemplary embodiment, the angle θ of the housing tapering can be from 50 to 70 degrees.

An operation of the bubble removing apparatus having the above configuration will now be described.

For example, if the ink circulation line 600 is required to be newly filled due to the change of the ink tank 500 or if there is otherwise a high possibility of introducing air bubbles into the filter unit 900, the following bubble removing process is performed. Also, since ink periodically is circulated through the ink circulation line 600 during a normal printing operation, air bubbles that enter the ink tank 500 are separated due to the gravitational force. However, air bubbles extant in ink tank 500 cannot be easily removed during a normal circulation operation of ink into the ink tank 500 and there is high possibility that the air bubbles will be trapped in the filter unit 900. The bubble removing process can be manually performed, or can be automatically operated in the case that there is high possibility that air bubbles are trapped in the filter unit 900 when the ink tank 500 is replaced.

Figure 9A:
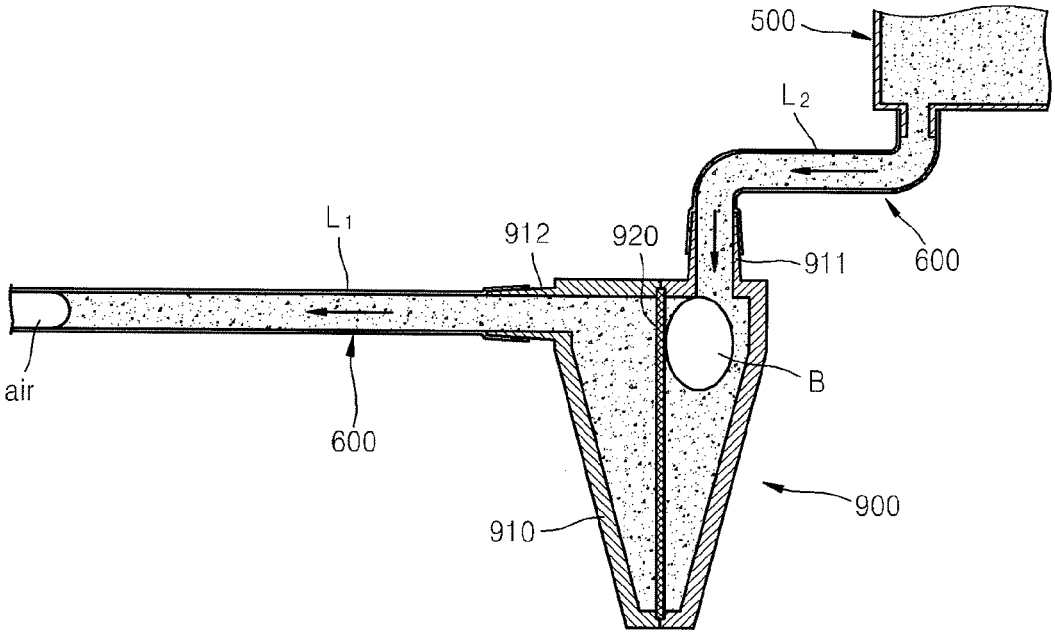
FIGS. 9A through 9D are cross-sectional views illustrating the use of a bubble removing apparatus mainly with the filter unit of FIG. 7, according to an embodiment of the present general inventive concept.

As illustrated in FIG. 9A, ink in the ink tank 500 is moved in the direction of printer head 100 (refer to FIG. 6) through the filter unit 900 along the ink circulation line 600 by operating the pump 700 that can be reversibly operated. Thus, an air bubble in the L2 section of circulation line 600 (refer to FIG. 9A) is pushed to the L1 section of circulation line 600 through the filter unit 900 by the movement of the ink. Ideally at this point, all of air in the L2 section is pushed to the L1 section. However, as illustrated in FIG. 9A, the air is accumulated in the form of air bubbles B near the ink inlet 911 on the inside of the filter 920. The trapped air bubbles B can cause pressure loss of the filter 920 as described above, and thus, the air bubbles B are removed by driving the pump 700 (refer to FIG. 6) in a reverse direction, which will be described below. The operation of the pump 700 in the forward direction must be stopped at an appropriate time prior to preceding to the next step (reverse direction), that is, the operation of pump 700 in the forward direction stops when ink that starts from the ink tank 500 travels in the L1 section of circulation line 600*a* distance at least slightly longer than the length of the L2 section so that air that has collected in front of the ink in the L1 section towards printer head 100 cannot re-enter the filter unit 900 during a subsequent driving of the pump 700 in the reverse direction. Thus, as described above, it is necessary to satisfy the condition of L1>L2.

Figure 9B:
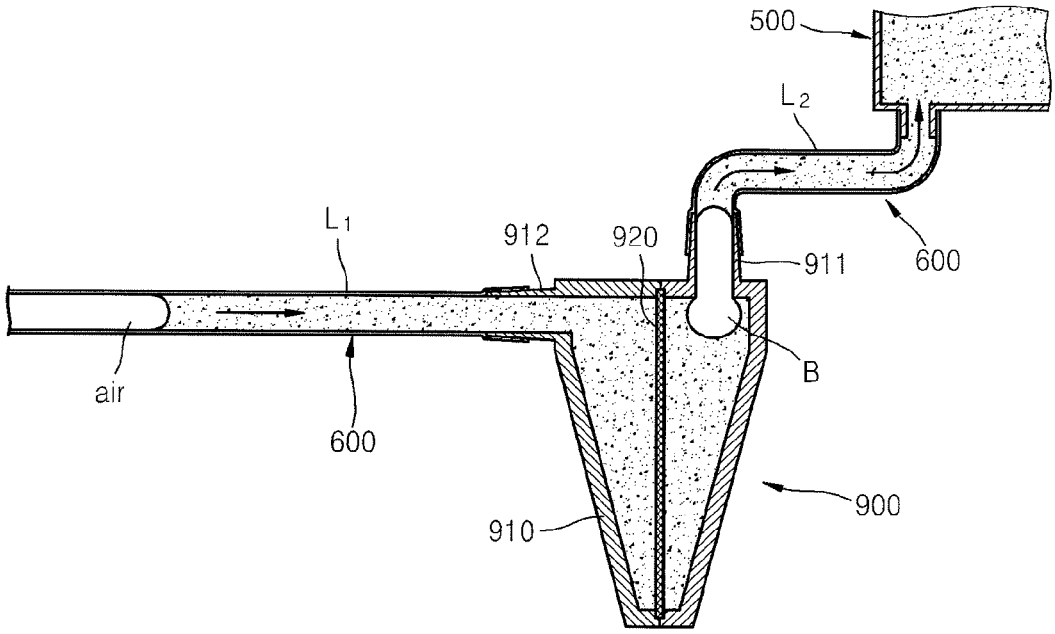
Figure 9C:
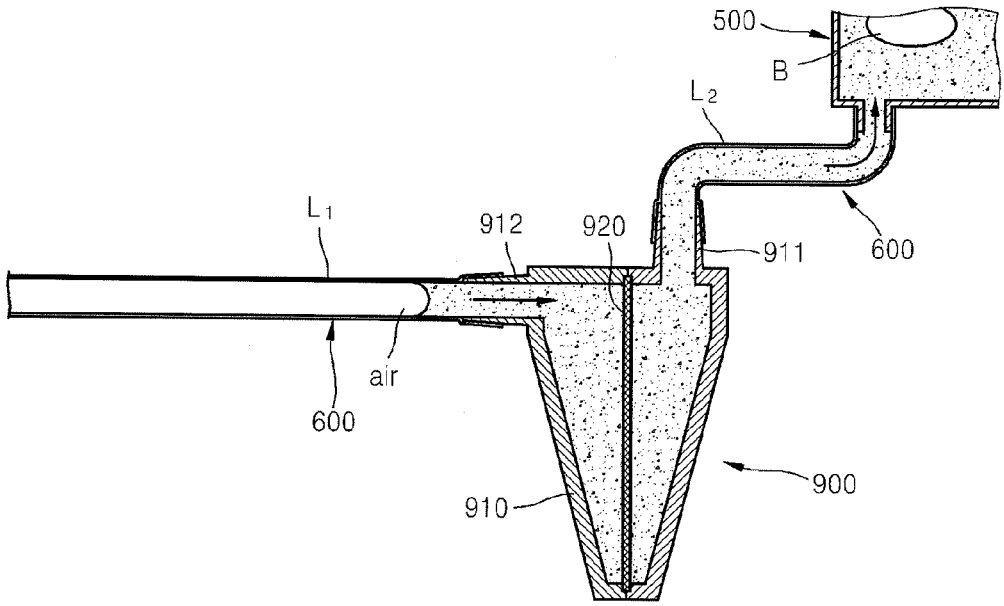

For reverse operation, once the ink has filled the L1 section from the L2 section due to the forward direction of operation, as illustrated in FIG. 9A, the ink that has moved to the L1 section is returned to the ink tank 500 by operating the pump 700 in a reverse direction as illustrated in FIG. 9B. Thus, air bubbles B trapped near the ink inlet 911 on the inside of the filter unit 900 are pushed back towards the ink tank 500 together with the ink returning to the ink tank 500. Accordingly, air bubbles B that do not pass the filter 920 into L1 during the forward operation of pump 700 enter the ink tank 500 where the air bubbles B are separated by gravitational forces due to the operation of the pump 700 in the reverse direction. At this point, since the air bubbles B trapped in the filter unit 900 can enter the ink tank 500, the pump 700 must be operated in the reverse direction for a period of time until the ink can move a distance at least longer than the length of the L2 section. However, if the pump 700 is operated in the reverse direction for a period of time such that the ink moves a distance substantially further than the length of the L2 section, the air bubbles B which have been pushed in the forward direction, that is, those air bubbles B which have accumulated near front of the L1 section towards printer head 100, can re-enter the filter unit 900. Therefore, the operation of the pump 700 in the reverse direction is stopped before the ink that has been moved to the front of the L1 section in the forward direction can re-enter the filter unit 900 in the reverse direction. For this reason, the ink is moved to the L1 section from the filter unit 900 for a longer distance than the length of the L2 section when operating the pump 700 in the forward direction. Thus, even though the ink may be moved in the reverse direction a distance slightly longer than the length of the L2 section, the air bubbles B present in front of the ink in the L1 section cannot re-enter the filter unit 900. As illustrated in FIG. 9C, due to the operation of the pump 700 in the reverse direction, the air bubbles B trapped in the filter unit 900 leave for the ink tank 500.

Figure 9D:
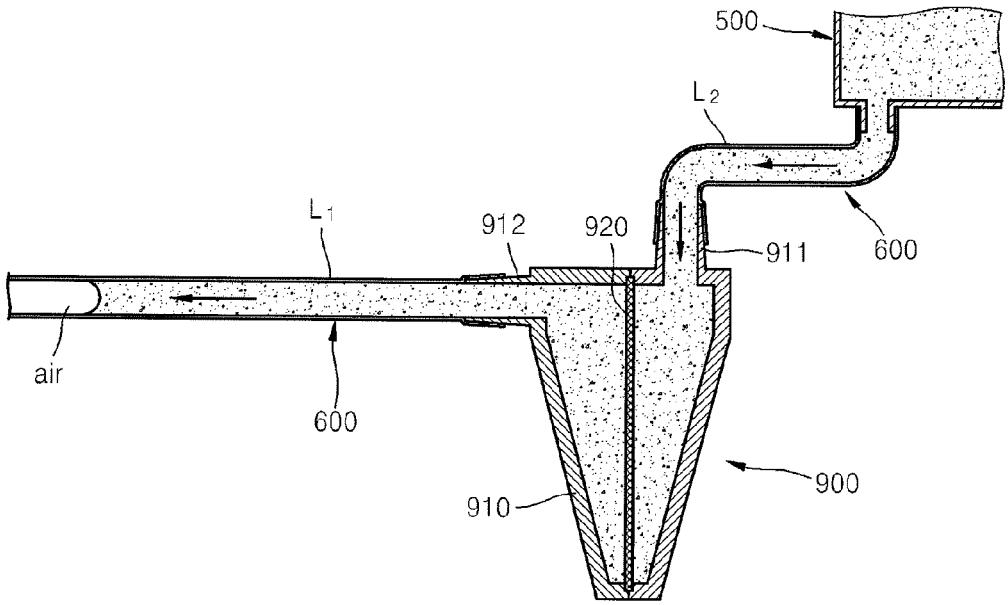

Again in the forward direction, as illustrated in FIG. 9D, the ink circulation line 600 is filled with ink by driving the pump 700 in the forward direction, without air bubbles B entering filter unit 900, and thus, an inkjet printer can enters normal operation.

According to the present general inventive concept, since normal operation begins when the air bubbles B trapped in the filter unit 900 are completely removed to ink tank 500, a pressure loss during printing operation can be prevented.

As described above, through the use of a bubble removing apparatus of an inkjet printer according to the present general inventive concept, air bubbles trapped in a filter unit can be readily removed. Accordingly, an effective working surface of a filter can be sufficiently ensured, and thus, pressure loss during normal printing operation can be prevented, thereby an ink supply failure or a degradation of chips of a printer head can be prevented.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A bubble removing apparatus comprising:

an ink circulation line that connects an ink tank containing ink and a printer head;

a filter unit including an ink inlet and an ink outlet disposed on a same end of the filter unit, the filter unit installed on the ink circulation line to filter out foreign materials contained in the ink;

a housing having a filter disposed between the ink inlet and the ink outlet, wherein the housing is tapered such that the cross-sectional area of the housing gradually degreases in a direction away from the ink inlet; and a pump capable of operating in a forward and a reverse direction that operates to circulate the ink in the forward direction and in the reverse direction through the ink circulation line, wherein the ink circulation line has a length L1 from the ink outlet to the printer head greater than a length L2 from the ink inlet to the ink tank, and wherein L1>L2.

2. The bubble removing apparatus of claim 1, wherein the ink inlet and the ink outlet are formed at an upper end of the housing.

3. An image forming apparatus, comprising:

a printer head;

an ink tank to contain ink; and an air bubble removing apparatus having an ink circulation line to connect the ink tank and the printer head, a filter unit including an ink inlet and an ink outlet disposed on a same upper end of the filter unit, the filter unit installed on the ink circulation line to filter out foreign materials contained in the ink, and a pump capable of operating in a forward and a reverse direction that operates to circulate the ink in the forward direction and in the reverse direction through the ink circulation line, wherein the filter unit includes a housing is tapered such that the cross-sectional area of the housing gradually decreases in a direction away from the ink inlet, the housing including a filter disposed between the ink inlet and the ink outlet, and wherein the ink circulation line has a length L1 from the ink outlet to the printer head greater than a length L2 from the ink inlet to the ink tank.

4. A method of removing air bubbles of an inkjet printer, the method comprising:

moving ink in a forward direction from an ink tank to a printer head through a filter unit on an ink circulation line by operating a pump that can be operated in a forward pumping direction and a reverse pumping direction; and moving ink that has been moved to the printer head in a reverse direction and back to the ink tank through the filter unit by operating the pump in the reverse pumping direction, wherein the ink is moved in the forward direction a distance L1, the ink is moved in a reverse direction a distance L2; and L1 is greater than L2, and wherein ink moving in the initial forward direction is halted when ink traveling, through the circulation line reaches a reversing distance that is greater than the distance L2 and less than the distance L1, and ink is moved in the reverse direction from the reversing, distance and is returned into the filter unit subsequent to halting the ink in the initial forward direction.

5. The method of claim 4, wherein:

the operation of the pump in the forward direction is continued until the ink moving in the initial forward direction in the ink circulation line after leaving the filter unit reaches the reverse distance; and the operation of the pump in a reverse direction is continued until the ink has been moved a distance which is substantially the same as the length of the ink circulation line from the filter unit to the ink tank and before all of the ink that passed through the filter unit when the pump was operated in the forward direction has returned to the filter unit.

6. The method of claim 4, further comprising:

moving ink in the ink tank to the printer head by operating the pump in the forward direction after operating the pump in the reverse direction.

7. A method of removing air bubbles in an inkjet printer, comprising:

moving ink in a first direction in an ink circulation line from an ink tank through a filter unit and toward a printer head; and moving ink in the ink circulation line in a second direction opposite from the first direction;

wherein the ink is moved in the first direction a distance L1, the ink is reversed when the ink reaches the distance L1 and is moved in the second direction a distance L2, the ink in the second direction is halted prior to returning entirely into the filter unit and is again moved in the first direction; and L1 is greater than L2, and wherein, moving the ink in the first direction causes air bubbles embedded in the ink to become trapped in the filter unit and moving the ink in the second direction causes substantially all the trapped air bubbles to be moved into the ink tank.

8. The method of claim 7, wherein L1 is substantially the length of the ink circulation line from the filter unit to the printer head.

9. The method of claim 8, wherein L2 is substantially the length of the ink circulation line from the filter unit to the ink tank.

10. An image forming apparatus, comprising:

a printer head;

an ink tank; and an air bubble removing apparatus having an ink circulation line to connect the ink tank and the printer head, including an ink inlet and an ink outlet disposed on a same upper end of the filter unit, the filter unit installed on the ink circulation line and spaced apart from the printer head a first distance and spaced apart from the ink tank a second distance shorter than the first distance, wherein the filter unit includes a housing having a filter disposed between the ink inlet and the ink outlet, wherein the housing is tapered such that the cross-sectional area of the housing gradually decreases in a direction away from the ink inlet.

* * * * *